US006377234B1

(12) United States Patent
Nogawa

(10) Patent No.: US 6,377,234 B1
(45) Date of Patent: Apr. 23, 2002

(54) LIQUID CRYSTAL DISPLAY CIRCUIT USING PULSE WIDTH AND FRAME MODULATION TO PRODUCE GRAYSCALE WITH CONTINUITY

(75) Inventor: Shinichi Nogawa, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/351,507

(22) Filed: Jul. 12, 1999

(51) Int. Cl.[7] ..... G09G 3/36
(52) U.S. Cl. ..... 345/89; 345/94
(58) Field of Search ..... 345/89, 94, 87, 345/98, 100, 99, 147, 148, 204, 63, 77; 349/33

(56) References Cited

U.S. PATENT DOCUMENTS 4,743,096 A * 5/1988 Wakai et al. ..... 345/89
4,775,891 A * 10/1988 Aoki et al. ..... 345/87
5,023,603 A * 6/1991 Wakimoto et al. ..... 345/148
5,414,442 A * 5/1995 Yamazaki et al. ..... 345/89
5,465,102 A * 11/1995 Usui et al. ..... 345/89
5,583,530 A * 12/1996 Mano et al. ..... 345/89
5,638,091 A * 6/1997 Sarrasin ..... 345/147
5,745,087 A 4/1998 Tomiyoshi et al. ..... 345/89
5,815,128 A * 9/1998 Hoshino et al. ..... 345/89
5,903,323 A * 5/1999 Ernstoff et al. ..... 345/148
6,043,801 A * 3/2000 Bassetti ..... 345/89
6,094,243 A * 7/2000 Yasunishi ..... 345/89
6,154,189 A * 11/2000 Tamura et al. ..... 345/89
6,184,874 B1 * 2/2001 Smith et al. ..... 345/204

FOREIGN PATENT DOCUMENTS

GB 2164190 3/1986

* cited by examiner

*Primary Examiner*—Steven Saras
*Assistant Examiner*—Paul A. Bell
(74) *Attorney, Agent, or Firm*—Adams & Wilks

(57) ABSTRACT

In a liquid crystal display circuit 100 enabling gradation display of a pixel by using both a pulse width modulation in which a drive pulse width PW for each segment is changed stepwise and a frame modulation in which the way of outputting a drive pulse is changed stepwise for each of one pair of frames F1 to F4 of a display screen, it is controlled for each of the frames of the display screen whether or not the pulse width PW of a segment signal of each pixel is increased by a minimum fine adjustment width, so that the total density of the frames F1 to F4 has continuity and unevenness does not occur in gradation setting.

6 Claims, 9 Drawing Sheets

| PALLET-DATA | | | | | FRAME | | PWD | |
|---|---|---|---|---|---|---|---|---|
| b4 | b3 | b2 | b1 | b0 | f1 | f0 | OUT | AorB |
| | | | 0 | 0 | 0 | 0 | 0 | A |
| | | | | | 0 | 1 | 0 | A |
| | | | | | 1 | 0 | 0 | A |
| | | | | | 1 | 1 | 0 | A |
| | | | 0 | 1 | 0 | 0 | 1 | B |
| | | | | | 0 | 1 | 0 | A |
| | | | | | 1 | 0 | 0 | A |
| | | | | | 1 | 1 | 0 | A |
| | | | 1 | 0 | 0 | 0 | 1 | B |
| | | | | | 0 | 1 | 0 | A |
| | | | | | 1 | 0 | 1 | B |
| | | | | | 1 | 1 | 0 | A |
| | | | 1 | 1 | 0 | 0 | 1 | B |
| | | | | | 0 | 1 | 1 | B |
| | | | | | 1 | 0 | 1 | B |
| | | | | | 1 | 1 | 0 | A |

| PALLET-DATA | | | | | GRAY-LEVEL | | |
|---|---|---|---|---|---|---|---|
| PW | | | FRM | | PW | PW-total | |
| b4 | b3 | b2 | b1 | b0 | | COMVENTION | INVENTION |
| 0 | 0 | 0 | 0 | 0 | 0 | 0 | 0 |
| 0 | 0 | 0 | 0 | 1 | | 0 | 1 |
| 0 | 0 | 0 | 1 | 0 | | 0 | 2 |
| 0 | 0 | 0 | 1 | 1 | | 0 | 3 |
| 0 | 0 | 1 | 0 | 0 | 1 | 1 | 4 |
| 0 | 0 | 1 | 0 | 1 | | 2 | 5 |
| 0 | 0 | 1 | 1 | 0 | | 3 | 6 |
| 0 | 0 | 1 | 1 | 1 | | 4 | 7 |
| 0 | 1 | 0 | 0 | 0 | 2 | 2 | 8 |
| 0 | 1 | 0 | 0 | 1 | | 4 | 9 |
| 0 | 1 | 0 | 1 | 0 | | 6 | 10 |
| 0 | 1 | 0 | 1 | 1 | | 8 | 11 |
| 0 | 1 | 1 | 0 | 0 | 3 | 3 | 12 |
| 0 | 1 | 1 | 0 | 1 | | 6 | 13 |
| 0 | 1 | 1 | 1 | 0 | | 9 | 14 |
| 0 | 1 | 1 | 1 | 1 | | 12 | 15 |
| 1 | 0 | 0 | 0 | 0 | 4 | 4 | 16 |
| 1 | 0 | 0 | 0 | 1 | | 8 | 17 |
| 1 | 0 | 0 | 1 | 0 | | 12 | 18 |
| 1 | 0 | 0 | 1 | 1 | | 16 | 19 |
| 1 | 0 | 1 | 0 | 0 | 5 | 5 | 20 |
| 1 | 0 | 1 | 0 | 1 | | 10 | 21 |
| 1 | 0 | 1 | 1 | 0 | | 15 | 22 |
| 1 | 0 | 1 | 1 | 1 | | 20 | 23 |
| 1 | 1 | 0 | 0 | 0 | 6 | 6 | 24 |
| 1 | 1 | 0 | 0 | 1 | | 12 | 25 |
| 1 | 1 | 0 | 1 | 0 | | 18 | 26 |
| 1 | 1 | 0 | 1 | 1 | | 24 | 27 |
| 1 | 1 | 1 | 0 | 0 | 7 | 7 | 28 |
| 1 | 1 | 1 | 0 | 1 | | 14 | 29 |
| 1 | 1 | 1 | 1 | 0 | | 21 | 30 |
| 1 | 1 | 1 | 1 | 1 | | 28 | 31 |
| | | | | | LEVEL-LESS | 11<br>13<br>17<br>19<br>22<br>23<br>25<br>26<br>27<br>29<br>30<br>31 | NONE |

Fig.7

LIQUID CRYSTAL DISPLAY CIRCUIT USING PULSE WIDTH AND FRAME MODULATION TO PRODUCE GRAYSCALE WITH CONTINUITY

BACKGROUND OF THE INVENTION

The present invention relates to a liquid crystal display circuit for driving a liquid crystal of a portable information terminal or the like, and move particularly to a liquid crystal display circuit capable of changing the tone of each pixel stepwise.

Conventionally,. in order to make the tone of each pixel have gradation, as shown in FIG. 9(*a*), there is known a means in which for a common signal COM 1, eight pulse signals of PW=1 to 8 with different pulse widths are prepared as segment signals for driving pixels, and a driving time is finely adjusted thereby. The means is also called a PWM (pulse width modulation) system in the sense that the pulse width of a segment signal is made variable. In this PWM system, as the variable width of the pulse width is made fine, the precision of the gradation becomes excellent, while there occurs a problem in that as the variable width is made fine, the frequency of a control clock becomes high.

In addition to the control of the pulse width, as shown in FIG. 9(*b*), there is also a system using frame modulation as well in which the way of outputting a segment pulse is changed to x1, x2, x3, and x4 for each of a pair of frames F1, F2, F3, and F4 of a display screen so that tone control is made. In this manner, in order to achieve fine tone control, it is desirable to use both the pulse width modulation and the frame modulation, and this has been common as a system of gradation control.

As is understood from FIG. 9(*b*), the conventional method of frame modulation is performed such that control is made as to whether or not a signal prepared as a segment signal is output in one pair of continuous frames, and such an effect can be expected that when the signal is output for all frames (the case of x4 in the example of FIG. 9(*b*)), the pixel becomes dense, and in the case where the signal is output for once every four frames as in the example of x1 of FIG. 9(*b*), the pixel becomes pale.

SUMMARY OF THE INVENTION

However, since conventional frame modulation is a method of determining whether or not a segment signal is output, there has been a problem in that when an attempt is made to control gradation stepwise, it lacks continuity.

This will be described with reference to FIG. 10. In a timing diagram shown in FIG. 10(*a*), when the pulse width of a segment signal to be output is 1 (PW=1), since it is possible to effect control such that one pulse is output or two pulses are output (26 to 29) in the continuous four frames (F1, F2, F3, and F4), when summing is made in the four frames, the fineness, that is, the sum of segment driving times in the four frames is continuous as 1, 2, 3, and 4. On the other hand, in the case of FIG. 10(*b*), since the pulse width of a segment signal to be output is 3 (PW=3), the fineness becomes discrete values such as 3, 6, 9, and 12.

When continuity of gradation control is considered, in the conventional system, as described above, since gradation setting becomes discrete and unevenness occurs, there occurs a number of levels which can not be set through the driving time of a total of the four frames. This means that since control intervals are irregular in the case where gradation control is made stepwise, tone control becomes partially impossible.

An object of the present invention is to provide a liquid crystal display circuit which is improved and is capable of solving the foregoing problem in a liquid crystal display device in which tone control of a pixel is made by using both pulse width modulation and frame modulation.

In order to solve the foregoing problem, according to the present invention, in a liquid crystal display circuit enabling gradation display of pixel by using both pulse width modulation in which drive pulse width for each segment is changed stepwise and frame modulation in which the manner of outputting a drive pulse is changed stepwise for each of one pair of frames of a display screen, control is made for each of the frames of the display screen as to whether or not a pulse width of a drive signal of each pixel is to be increased by a minimum fine adjustment width, so that the total density of the one pair of frames has continuity and unevenness does not occur in gradation setting.

In the above structure the device, it is also possible to structure such that it is determined by a value of lower bits of a gradation pallet whether or not the width of the drive signal of each pixel is increased by the minimum fine adjustment width.

BRIEF DESCRIPITON OF THE DRAWINGS

FIG. 7 is an explanatory diagram for explaining the operation of the liquid crystal display circuit of FIG. 1.

DESCRIPTION OF THE PREFERRED EMBODIMENTS

Hereafter, an embodiment of the present invention will be described in detail with reference to the drawings.

Figure 1:
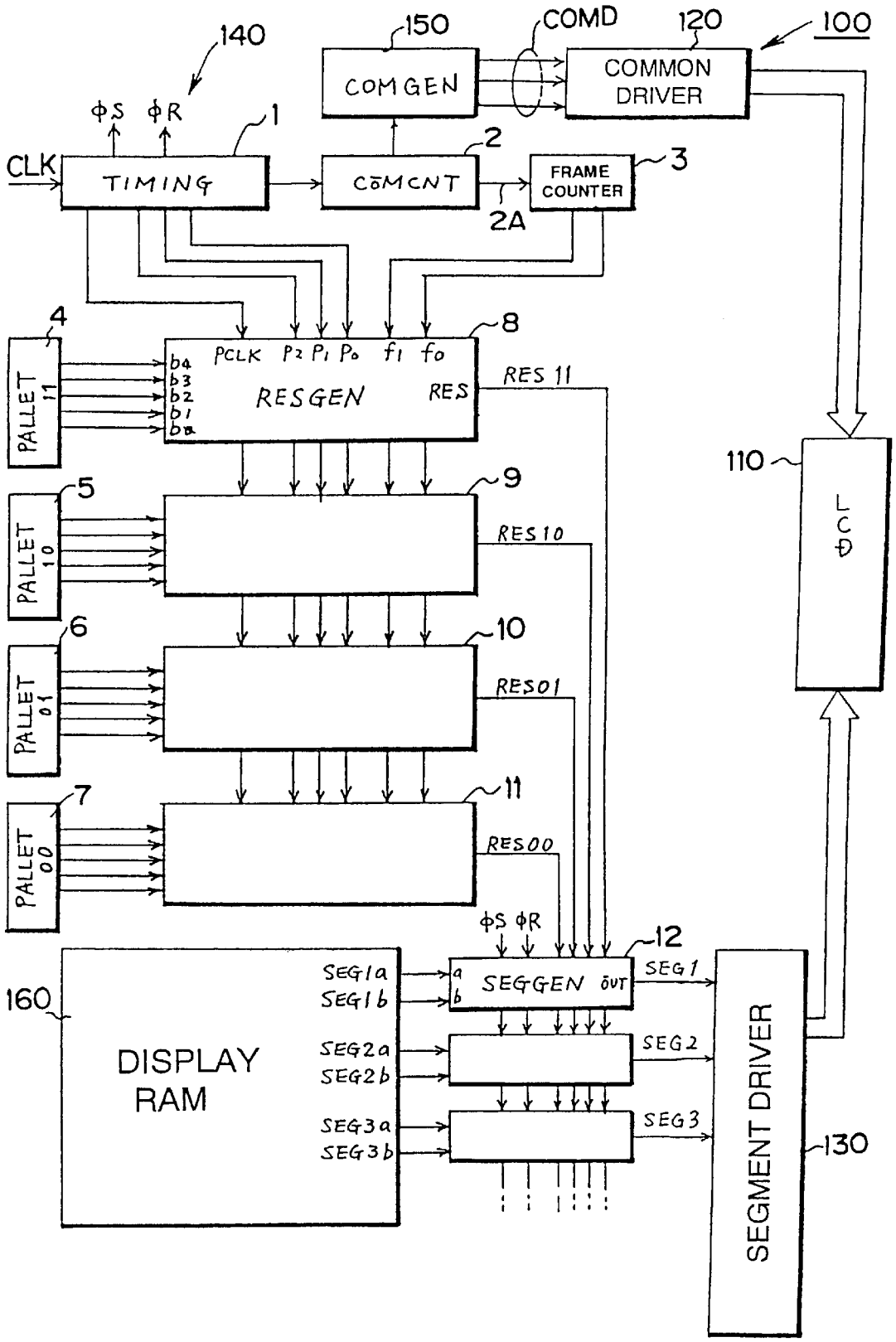
FIG. 1 is a block diagram showing an embodiment of a liquid crystal display device according to the present invention.

FIG. 1 is a block diagram showing an embodiment of a liquid crystal display device according to the present invention.

A liquid crystal display device 100 is a liquid crystal display device for displaying figures, characters, and the like through a dot matrix display system in a liquid crystal display (LCD) 110.

The liquid crystal display (LCD) 110 has a well-known structure in which a liquid crystal is sealed between a pair of transparent glass substrates, a plurality of scanning lines and signal lines are formed in a matrix form on the opposite surfaces of the pair of transparent glass substrates, a display dot made of liquid crystal is formed at each intersection point of the scanning lines and the signal lines, the scanning lines and the signal lines are sequentially selectively driven by a common driver 120 and a segment driver 130, and an electric charge is stored in the liquid crystal at the sequentially selected intersection points, so that characters and images can be displayed.

Next, the structure of a display control portion 140 for generating a common signal and a segment signal respectively supplied to the common driver 120 and the segment driver 130 will be described.

Figure 8:
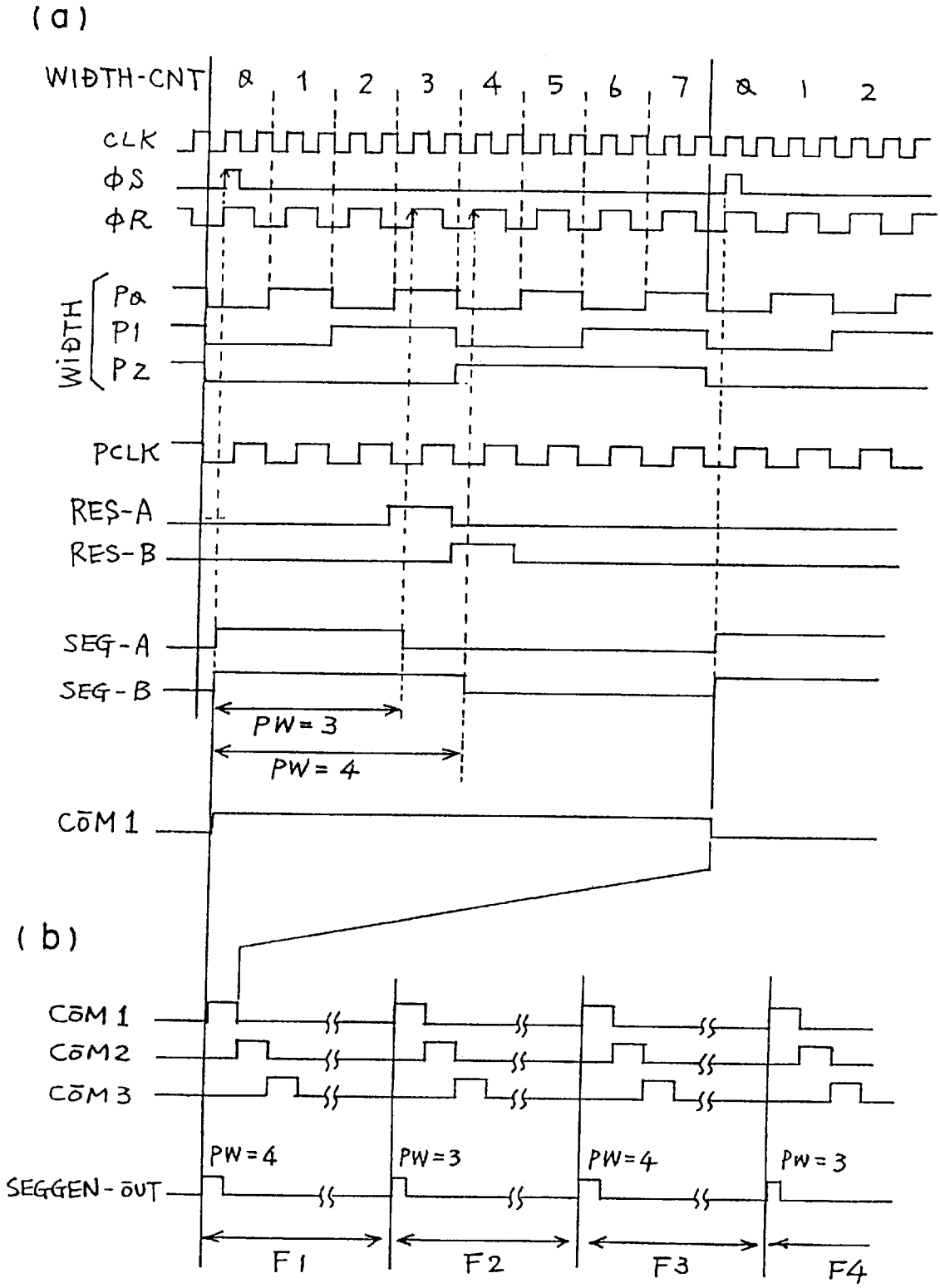
FIG. 8 is a waveform diagram showing waveforms of signals of the respective portions of the liquid crystal display circuit shown in FIG. 1.
Figure 9:
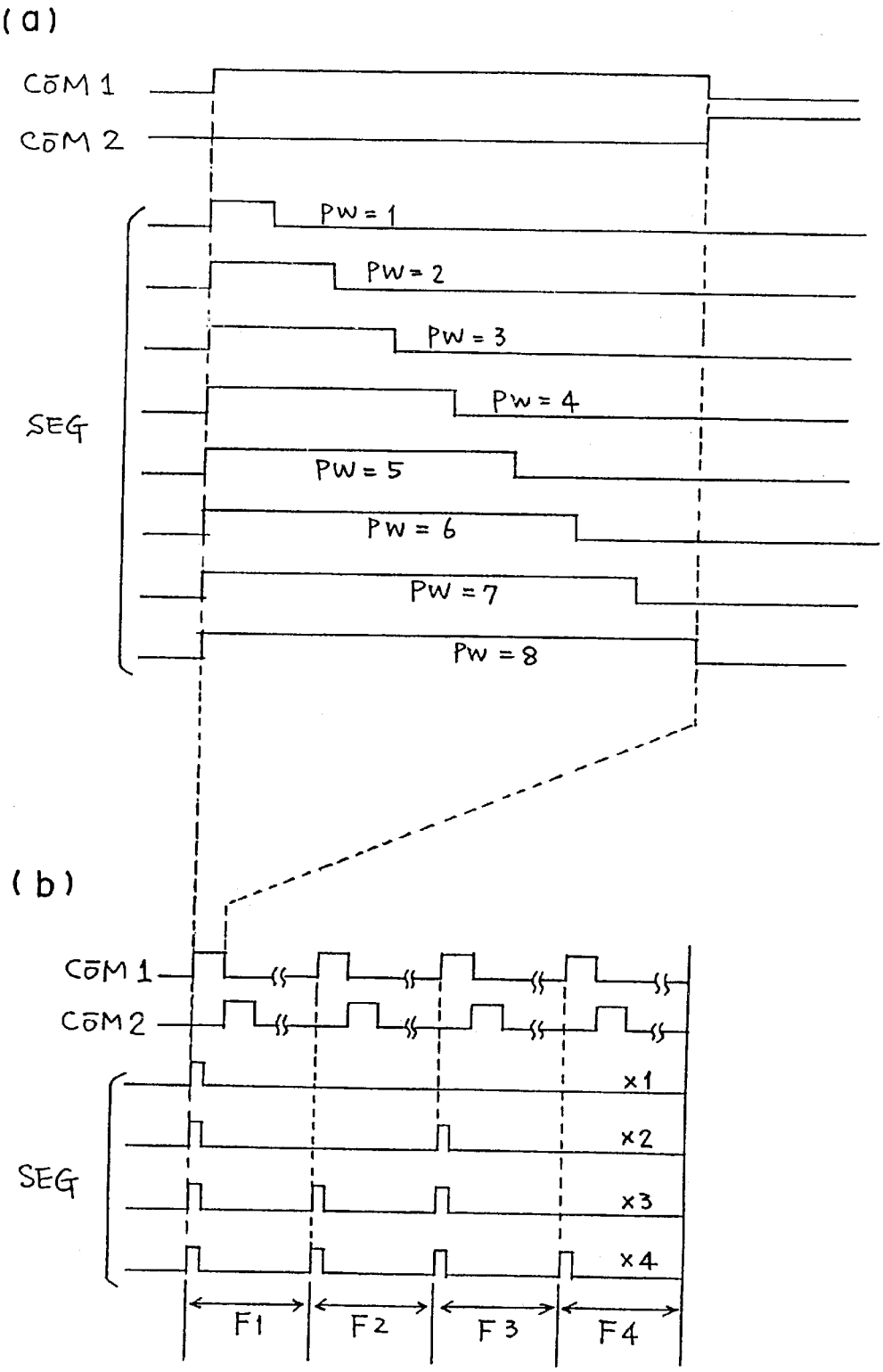
Fig.9 PRIOR ART
FIG. 9 is a signal waveform diagram for explaining a conventional method of gradation control of a liquid crystal display circuit.
Figure 10:
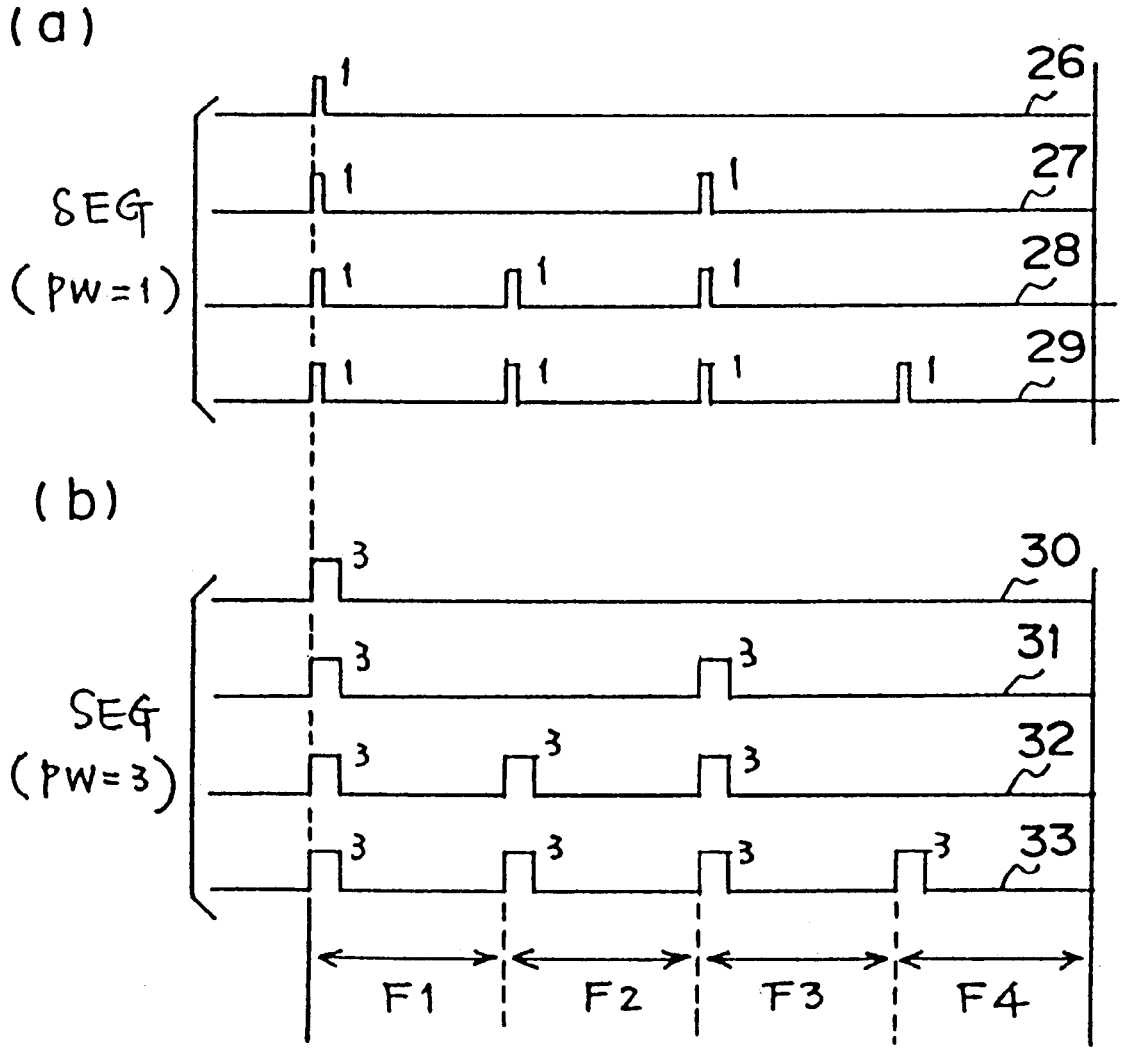
Fig.10 PRIOR ART
FIG. 10 is a signal waveform diagram for explaining the conventional method of gradation control of the liquid crystal display circuit.

Reference numeral 1 denotes a timing pulse generating circuit (TIMING) which receives a clock pulse CLK supplied from a not-shown clock pulse generator and generates timing pulses PCLK, P0 to P2, 0S, and 0R. As shown in FIG. 8, the timing pulse 0S is a pulse train signal composed of pulses corresponding to common front clock pulses, and the timing pulse 0R is a ½ frequency divided pulse signal of a clock pulse CLK synchronizing with the pulse rising timing of the timing pulse 0S. The timing pulses P0 to P2 are one pair of pulse signals for indicating any one of gradations of four levels by the pulse width modulation. The timing pulse PCLK is a ½ frequency divided pulse signal of the clock pulse CLK synchronizing with the falling timing of the timing pulse 0S.

A common counter (COMCNT) 2 for determining the position of a display common is a counter of a predetermined bit length for counting the common clock CLK from the timing pulse generating circuit 1, and a frame counter 3 outputs frame signals f0 and f1 for indicating the frame number at that time in two bits in response to an output 2A from the common counter 2. Reference numeral 150 denotes a common signal generating circuit (COMGEN) for outputting a common signal COMD in response to the output from the common counter 2.

Reference numerals 4 to 7 denote pallets (PALLET) comprised of registers, or latches, for setting gradation levels to effect gradation control. In this embodiment, in order to realize 32 gradations, each pallet is structured to provide a five bit output, and four pallets are prepared.

In each of the pallets 4 to 7, successively from the MSB of data comprising the corresponding gradation data, five bits of data comprising b4, b3, b2, b1, and b0 are input to reset signal generating circuits (RESGEN) 8 to 11. The timing pulses PCLK, P0 to P2, frame signals f1 and f0 are input to the reset signal generating circuits 8 to 11, respectively. Each of the reset signal generating circuits 8 to 11 determines the timing at which the segment signal to be output is cut off (negate), and cutoff timing signals RES00, RES01, RES10, and RES11 showing the determination result are input to a segment signal generating circuit (SEGGEN) 12.

Figure 2:
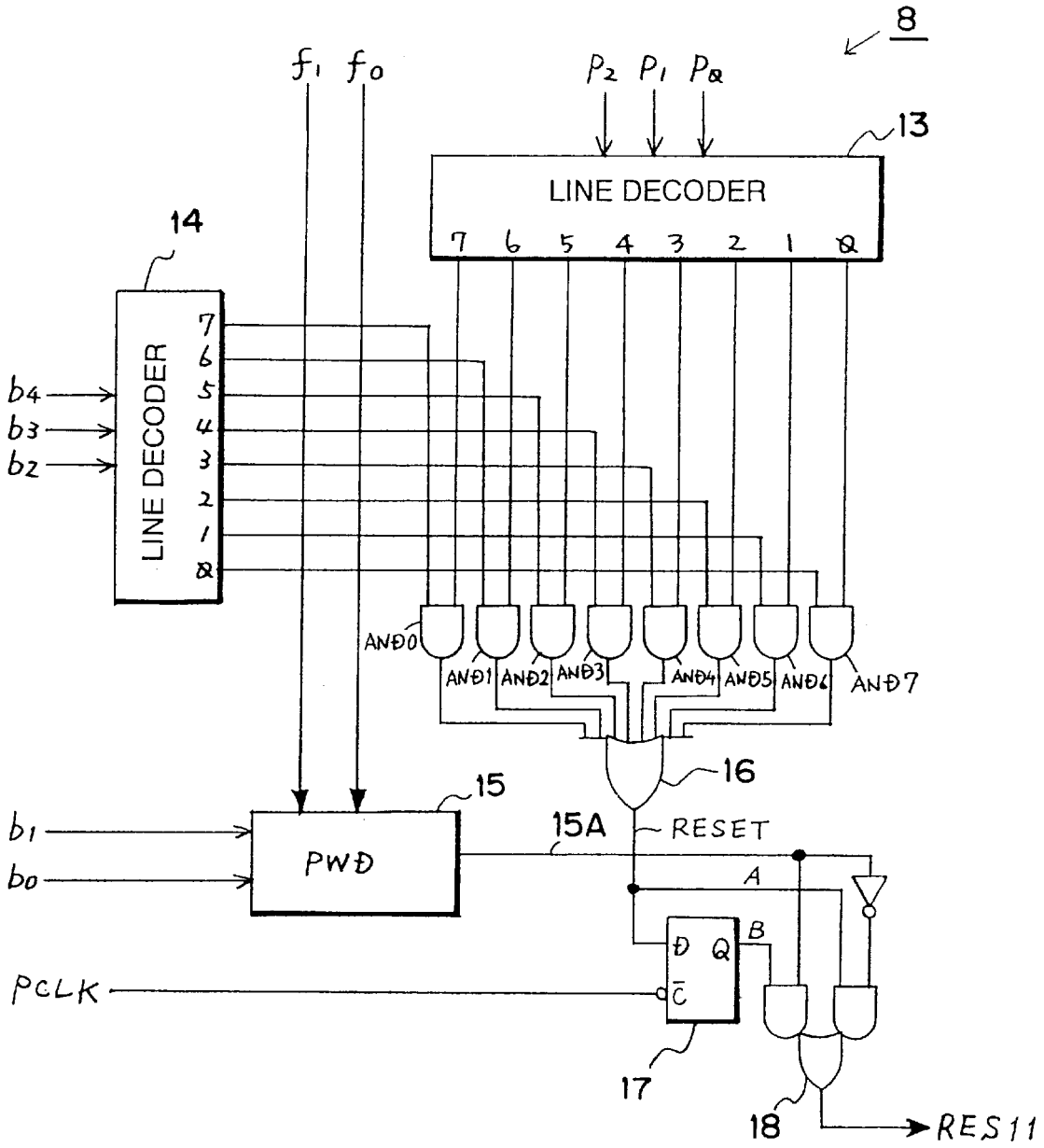
FIG. 2 is a detailed circuit diagram of a reset signal generating circuit shown in FIG. 1.

FIG. 2 is a detailed circuit diagram of the reset signal generating circuit 8. In FIG. 2, although detailed description will be made on the basis of the structure of the reset signal generating circuit 8, other reset signal-generating circuits 9, 10 and 11 have the same structure.

Reference numeral 14 denotes a line decoder for decoding the upper three bit data b4, b3, and b2 in the five bit data from the pallet 4 and making active one of outputs 0 to 7. The other line decoder 13 decodes the timing pulses P2, P1 and P0 from the timing pulse generating circuit 1, and a corresponding output of its eight outputs is made "H". The timing pulse generating circuit 1 responds to the clock pulse CLK, and the timing pulses P2, P1, and P0 are steadily counted, so that the line decoder 13 sequentially scans the outputs 0 to 7.

For each output of the line decoder 13 and each output of the line decoder 14, the logical product of corresponding outputs is taken by AND gates AND0 to AND7, and when the output of any one of the AND gates AND0 to AND7 becomes "H", the output of an OR gate 16 becomes "H" and a reset signal RESET is generated. If control by only pulse width modulation is made, the output of the OR gate 16 follows a passage A, and generates a cutoff timing signal RES11 at the output of an AND-OR gate 118.

In the case where frame modulation is also used, in order to realize continuity in gradation, there is prepared a passage B for delaying the reset signal RESET in the case of the passage A with the aid of a D-type flip-flop 17 by one pulse of the timing pulse PCLK. In the case where the passage B is selected, the pulse width of the segment signal becomes larger by one pulse of the timing pulse PCLK.

Reference numeral 15 denotes a selecting circuit (PWD) for outputting a selection signal 15A to select one of the passages A and B. The selecting circuit 15 makes the selection signal 15A "L" or "H" in response to the frame signals f0 and f1 indicating the frame number at that time, and data b1 and b0 of the lower two bits from the pallet 4 to determine into which frame of one pair of four frames F1 to F4 the wide segment signal is to be inserted. When the selection signal 15A is at an "L" level, the passage A is selected, and when the selection signal 15A is at an "H" level, the passage B is selected.

Figures 3, 4:
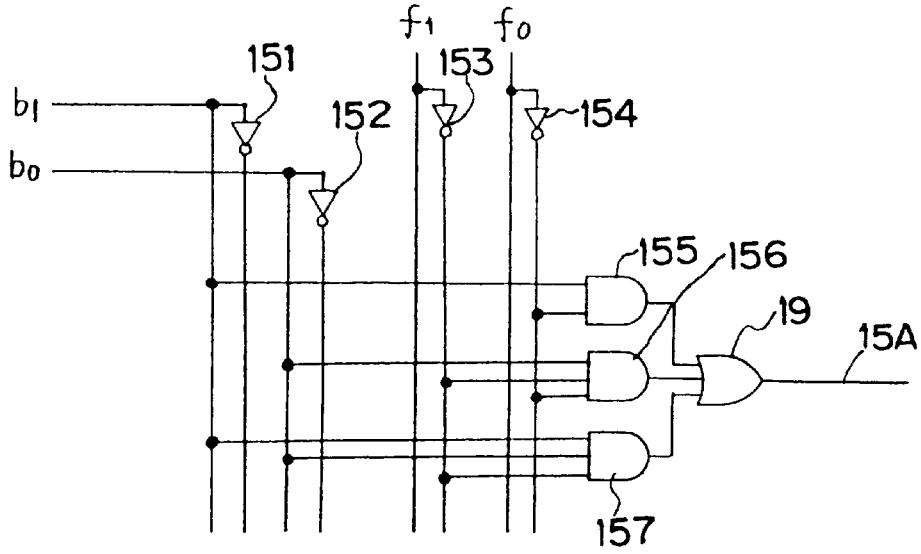
FIG. 3 is a specific circuit diagram of a selecting circuit shown in FIG. 2.
FIG. 4 is an explanatory diagram for explaining the operation of the selecting circuit shown in FIG. 3.

FIG. 3 is a specific circuit diagram of the selecting circuit 15, and FIG. 4 shows the function of the selecting circuit 15. In FIG. 3, reference numerals 151 to 154 denote inverters, 155 to 157 denote AND gates, and 19 denotes an OR gate. As shown in FIG. 4, it is understood that the selection signal 15A to determine the passage A or the passage B for each of the continuous frames (f1f0=00, 01, 10, 11) is output by the data b1 and b0 of the lower two bits from the pallet 4.

According to the circuit of FIG. 3, it is structured such that when the data b1 and b2 of the lower two bits of the output from the pallet 4 is 00, there is no passage B (only passage A), when 01, the passage B is selected only one time, and when 10, the passage B is selected two times. When the passage B is selected two times in these four frames, it is preferable not to select the passage B in the continuous frames but to select the passage B every other frame. This is because when control is made as dispersedly as possible, the effect is to reduce flicker of the screen. When the data b1 and b0 of the lower two bits of the output of the pallet 4 is 11, the passage B is selected in three of the four frames.

In this manner, the reset signal generating circuit 8 is structured such that the basic pulse width of the segment signal is determined by the data contents of the upper three bits of the pallet 4, and it is determined by the data contents of the lower two bits of the pallet 4 whether or not the basic pulse width is added with the minimum control width for each frame. By this, a circuit structure in which both pulse width control and individual control for each frame are used is realized.

The reset signal generating circuits 9 to 11 provided correspondingly to the outputs of the other pallets 5 to 7 have the same operation, and the cutoff timing signals RES11 to RES00 obtained as the result of this are input to the segment signal generating circuit 12.

Figure 5:
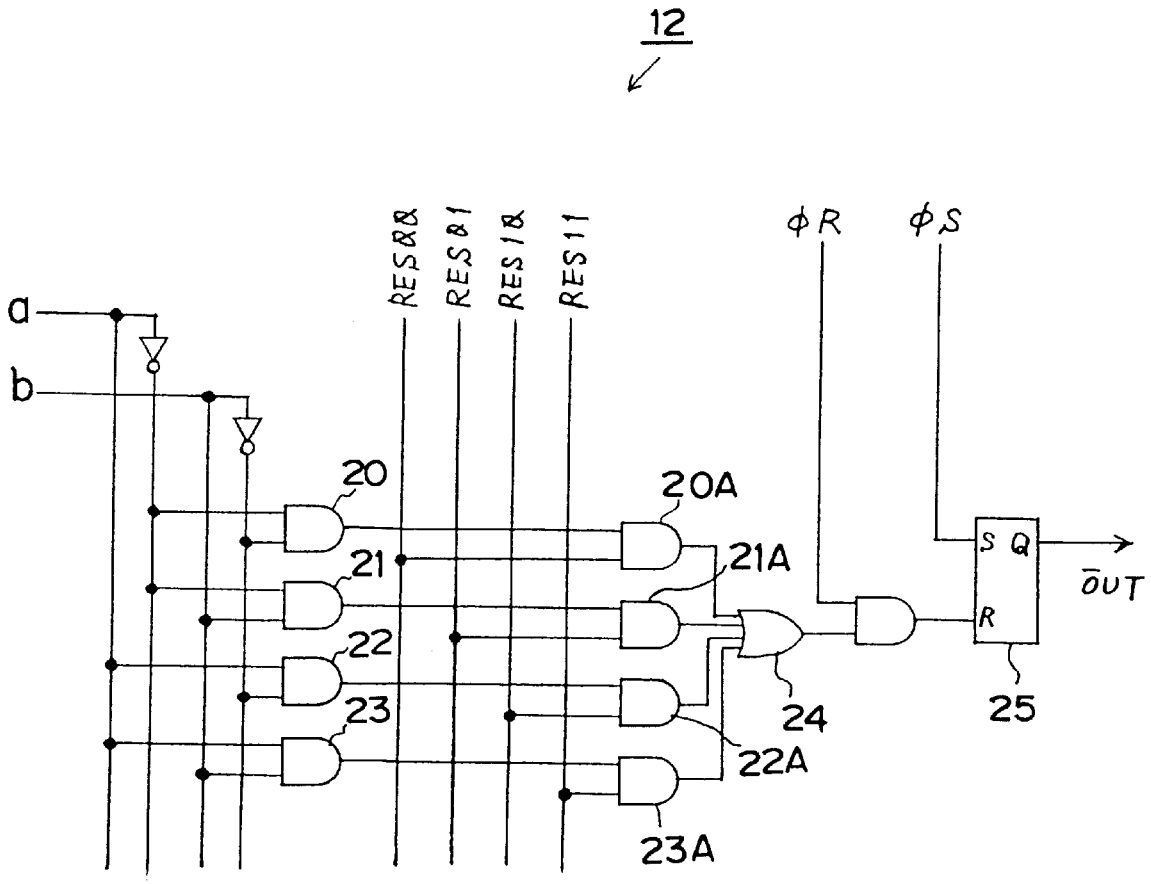
FIG. 5 is a detailed circuit diagram of a segment signal generating circuit shown in FIG. 1.

FIG. 5 is a detailed circuit diagram of the segment signal generating circuit 12.

The Q-output of a latch circuit 25 constituted by an R-S flip-flop becomes a segment signal SEG1. Thus, when the timing pulse 0S is input to the set (S) side of the latch circuit 25, the corresponding segment is turned ON, and when a strobe signal of the timing pulse 0R is input to the reset (R) side, the corresponding segment is turned OFF.

As is understood from FIG. 8, the timing pulse 0S is outputted at the timing of the front of each common signal without fail. On the other hand, since a signal made of the timing pulse 0R is output at various times, this changes a segment drive time. Reference characters "a" and "b" of FIG. 5 denote data given from a display RAM 160 and indicating by which gradation of the four kinds the pixel is displayed. If the gradation control is for four colors, two. signals are sufficient, and if for black and white, one signal is sufficient. AND gates 20 to 23 are decode outputs of the data "a" and "b", and decodes ab=00, 01, 10, and 11.

Since any one of the AND gates 20 to 23 is turned ON, any one of the cutoff timing signals RES00, RES01, RES10, or RES11 is selected as an effective signal by the AND gates 20A to 23A, and a signal in which the OR gate 24 is made to strobe is formed. Thus, the cutoff timing signals RES00 to RES11 determine a pulse width timing to determine each gradation of four colors.

Since the display control portion 140 is structured as described above, as shown in FIG. 7, in the case where the output b0 to b4 of five bits from each of the pallets 4 to 7 indicates any one density of 32 stages, the basic pulse width (PW) of the segment signal is set to any of 0 to 7, by using the data (b4, b3, and b2) of the upper three bits. Specifically, judgement is made by the line decoder 14 shown in FIG. 2. The reset signal RESET is output on the basis of the output of this line decoder 14, and the basic pulse width is determined. On the other hand, in order to determine the increase amount of pulse width for each of one pair of four frames which use the same basic pulse width PW, the selecting circuit 15 uses data (b1 and b0) of the lower two bits from the pallet 4 and the frame signals f1 and f0, and determines the passage of the reset signal RESET to A or B as shown in FIG. 4.

Figure 6:
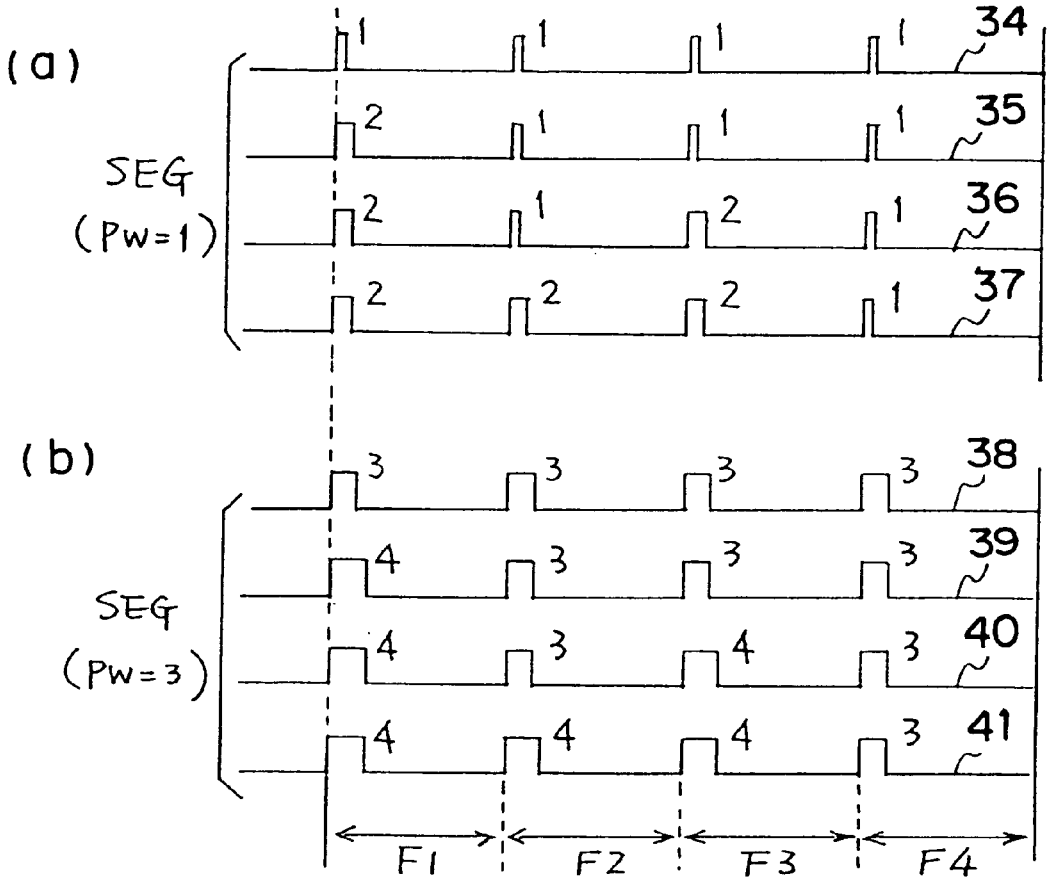
FIG. 6 is a waveform diagram of segment signals for explaining the operation of a liquid crystal display circuit of FIG. 1.

As a result, as shown in FIG. 6, the width of the segment signal appearing every four frames constituting one pair is increased by one pulse of the timing pulse PCLK according to data of 32 gradations. Although FIG. 6 shows only two cases of PW=1 and PW=3, even in the case other than this, in quite the same way, it is increased by one pulse of the timing pulse PCLK.

As a result, as shown in FIG. 7, to 32 gradations determined in the pallets, conventionally, although only discrete gradation can be obtained and lacks in continuity, according to the structure of FIG. 1, as shown in FIG. 6, continuity is achieved as the total density of four frames constituting one pair, and any one density among continuous gradations of 0 to 31 can be selected.

According to the present invention, as described above, control is performed for each frame of a display screen as to whether or not a pulse width of a drive signal of each pixel is increased by a minimum fine adjustment width, so that it is possible to achieve continuous gradation control in correspondent with gradations continuously set in a pallet. Thus, a high quality tone image can be displayed, and the display quality of a tone image with a liquid crystal can be greatly improved.

In a structure is made by which that it is determined by the value of least significant bits of a gradation pallet whether or not the pulse width of a drive signal of each pixel is increased by a minimum fine adjustment width, so that it is possible to easily make gradation control of gray levels in correspondent with gradation elements by output data of the pallet.

What is claimed is:

1. In a liquid crystal display circuit which enables a varying gradation display of a pixel in accordance with gradation data by using both a pulse width modulation technique in which a drive pulse width for each segment of a display is changed stepwise for successive pairs of successive frames of the display and a frame modulation technique in which a number of drive pulses output for each segment of the display is changed stepwise for successive pairs of successive frames of the display, a method of producing a varying gradation display comprising the steps of:

generating a reset signal for resetting the driving pulses to vary the pulse width thereof in accordance with the gradation data; and selectively delaying the reset signal by a minimum fine adjustment width so that the pulse width of a drive signal of each pixel is increased by the minimum fine adjustment width and a total density of the successive pairs of successive frames have continuity and unevenness does not occur in gradation setting.

2. A liquid crystal display circuit according to claim 1; further comprising the step of determining whether or not the pulse width of the drive signal of each pixel is to be increased by the minimum fine adjustment width based on a value of at least one least significant bit of gradation data supplied to a gradation pallet.

3. A liquid crystal display circuit according to claim 1; wherein the minimum fine adjustment width is equal to a minimum drive pulse width.

4. A drive circuit for a liquid crystal display, comprising: a liquid crystal display panel having a plurality of pixels each having a segment electrode and a common electrode and a liquid crystal material interposed therebetween; a timing pulse generating circuit for generating timing pulses; a segment driver for driving segment electrodes of the liquid crystal display panel in accordance with the timing pulses; a common driver for driving common electrodes of the liquid crystal display panel in accordance with the timing pulses; and a modulation circuit for selectively varying the pulse width of driving signals output by at least one of the segment driver and the common driver in accordance with gradation data in successive pairs of successive frames and for frame modulating the driving signals output by at least one of the segment driver and the common driver in accordance with the gradation data, the frame modulation being performed by controlling in successive pairs of successive frames a number of driving pulses generated at a pulse width set by the pulse width modulation technique, the modulation circuit including a reset signal generating circuit for generating a reset signal used for resetting the driving signals to vary the pulse width thereof in accordance with the gradation data, and a delay circuit for selectively delaying the reset signal by a minimum fine adjustment time, so that the pulse width of successive driving signals may be adjusted by the fine adjustment width.

5. A drive circuit according to claim 4; further comprising a counter for counting pulses of an input clock signal and outputting a frame signal indicating a frame number; a common signal generating circuit for outputting a common signal in response to the output signal of the counter; a plurality of pallets for setting gradation levels to effect gradation control and for outputting a plurality of bits of data indicating a desired gradation level; and wherein the reset signal generating circuit is connected to the respective pallets for receiving the outputs of the pallets, the timing pulses, the frame signal and a gradation signal, determines a timing at which a segment signal to be output is to be cut off, and outputs cutoff timing signals for cutting off the segment signal.

6. A drive circuit according to claim 5; wherein the reset signal generating circuit comprises a first line decoder for decoding an upper plurality of bits of outputs of the pallets and outputting a decoded signal, a second line decoder for decoding the gradation data and outputting a decoded signal, a plurality of AND gates for inputting decoded output signals of the first and second line decoders, and an OR gate connected to the outputs of the AND gates so that the OR gate output becomes high when any one of the outputs of the AND gates becomes high, and a circuit for determining, for each frame of a display, whether or not a pulse width of a drive signal of each pixel is to be increased by a minimum fine adjustment width, so that a gradation density of successive pairs of frames has continuity and unevenness does not occur in gradation setting.

* * * * *